US010767424B2

(12) United States Patent
Steine

(10) Patent No.: US 10,767,424 B2
(45) Date of Patent: Sep. 8, 2020

(54) DEVICE ARRANGED FOR ATTACHING A PIPE STEM ON A TUBULAR BODY

(71) Applicant: ACE OIL TOOLS AS, Randaberg (NO)

(72) Inventor: Ken Erik Steine, Hafrsfjord (NO)

(73) Assignee: ACE OIL TOOLS AS, Randaberg (NO)

( * ) Notice: Subject to any disclaimer, the term of this patent is extended or adjusted under 35 U.S.C. 154(b) by 0 days.

(21) Appl. No.: 15/983,777

(22) Filed: May 18, 2018

(65) Prior Publication Data

US 2018/0266193 A1 Sep. 20, 2018

Related U.S. Application Data

(63) Continuation of application No. 14/412,953, filed as application No. PCT/NO2013/000031 on Jul. 10, 2013, now Pat. No. 9,982,494.

(30) Foreign Application Priority Data

| | | |
|---|---|---|
| Jul. 12, 2012 | (NO) | 20120803 |
| Oct. 22, 2012 | (NO) | 20121235 |
| Feb. 7, 2013 | (NO) | 20130208 |

(51) Int. Cl.
*E21B 17/12* (2006.01)
*E21B 19/24* (2006.01)
(Continued)

(52) U.S. Cl.
CPC ..... *E21B 17/1078* (2013.01); *E21B 17/043* (2013.01); *E21B 17/046* (2013.01);
(Continued)

(58) Field of Classification Search
CPC .. E21B 17/1057; E21B 17/12; E21B 17/1078; E21B 19/24; E21B 17/046; E21B 17/043
See application file for complete search history.

(56) References Cited

U.S. PATENT DOCUMENTS

| | | | |
|---|---|---|---|
| 1,775,376 | A | 9/1930 | Alexander et al. |
| 1,889,059 | A | 11/1932 | Dennie |

(Continued)

FOREIGN PATENT DOCUMENTS

| | | |
|---|---|---|
| CA | 2582770 | 9/2008 |
| CN | 2621212 | 6/2004 |

(Continued)

OTHER PUBLICATIONS

Centek, Stop Collars (http://www.centekgroup.com/our-products/stop-collars/), Aug. 15, 2007.

(Continued)

*Primary Examiner* — Cathleen R Hutchins
(74) *Attorney, Agent, or Firm* — Andrus Intellectual Property Law, LLP

(57) ABSTRACT

An attachment device for an element is made to be arranged on a downhole tubular body, in which an end portion of a sleeve, which is arranged to surround a portion of the tubular body, comprises an attachment portion. The attachment portion comprises at least one clamping element arranged for axial displacement by the abutment of an abutment surface against a conical abutment portion of a surrounding adapter sleeve.

28 Claims, 4 Drawing Sheets

(51) Int. Cl.
*E21B 17/046* (2006.01)
*E21B 17/043* (2006.01)
*E21B 17/10* (2006.01)

(52) U.S. Cl.
CPC ..... *E21B 17/10* (2013.01); *E21B 17/12* (2013.01); *E21B 19/24* (2013.01)

(56) References Cited

U.S. PATENT DOCUMENTS

| | | | | |
|---|---|---|---|---|
| 1,903,467 | A | 4/1933 | Macclatchie | |
| 2,089,553 | A | 8/1937 | Walter et al. | |
| 2,320,553 | A | 6/1943 | Barnes et al. | |
| 2,328,771 | A | 9/1943 | Barnes et al. | |
| 2,633,632 | A | 4/1953 | Hall | |
| 2,669,773 | A | 2/1954 | Glenn | |
| 2,674,034 | A | 4/1954 | Stone | |
| 2,682,102 | A | 6/1954 | Stone et al. | |
| 2,693,633 | A | 11/1954 | Wood | |
| 2,751,019 | A * | 6/1956 | Baker | E21B 17/021 285/34 |
| 2,824,613 | A | 2/1958 | Baker et al. | |
| 2,824,813 | A | 2/1958 | Fauser et al. | |
| 2,836,446 | A | 5/1958 | Hall | |
| 2,845,287 | A | 7/1958 | Hall | |
| 2,872,226 | A | 2/1959 | Wright et al. | |
| 2,944,608 | A | 7/1960 | Rush | |
| 2,959,435 | A | 11/1960 | Winkelmann | |
| 2,988,386 | A | 6/1961 | Clifford | |
| 2,998,848 | A | 9/1961 | Wright et al. | |
| 3,004,335 | A | 10/1961 | Collett | |
| 3,040,405 | A | 6/1962 | Solum | |
| 3,089,545 | A | 5/1963 | Lilly | |
| 3,094,018 | A | 6/1963 | Collett | |
| 3,235,295 | A | 2/1966 | Solum | |
| 3,311,391 | A | 3/1967 | Harrell | |
| 3,398,795 | A | 8/1968 | Elliston | |
| 3,579,794 | A | 5/1971 | Powell | |
| 3,593,390 | A | 7/1971 | Pettigrew | |
| 3,652,138 | A | 3/1972 | Collett | |
| 3,710,427 | A | 1/1973 | Doly | |
| 3,789,493 | A | 2/1974 | Province | |
| 3,815,202 | A | 6/1974 | Squires | |
| 3,938,853 | A | 2/1976 | Jurgens et al. | |
| 4,000,549 | A | 1/1977 | Brumley et al. | |
| 4,349,050 | A | 9/1982 | Bergstrom et al. | |
| 4,378,135 | A | 3/1983 | Enen, Jr. et al. | |
| 4,384,626 | A | 5/1983 | Derouin | |
| 4,438,822 | A | 3/1984 | Russell | |
| 4,540,231 | A | 10/1985 | Forney, Jr. et al. | |
| 4,564,988 | A | 1/1986 | Norrod | |
| 4,600,063 | A | 7/1986 | Beasley | |
| 4,616,855 | A | 10/1986 | Ruhle | |
| 4,664,427 | A | 12/1987 | Johnston | |
| 4,748,730 | A | 6/1988 | George | |
| 4,769,889 | A | 9/1988 | Landman et al. | |
| 4,834,676 | A | 5/1989 | Tackett | |
| 5,099,561 | A | 3/1992 | Santiago | |
| 5,206,980 | A | 5/1993 | Chapman | |
| 5,592,726 | A | 1/1997 | Suresh | |
| 5,909,904 | A | 8/1999 | Shea | |
| 6,051,532 | A | 4/2000 | Burberry et al. | |
| 6,119,774 | A | 9/2000 | Doane et al. | |
| 6,312,021 | B1 | 6/2001 | Winfield | |
| 6,331,123 | B1 | 12/2001 | Rodrigues | |
| 6,536,532 | B2 | 3/2003 | Doane | |
| 6,843,516 | B2 | 1/2005 | Bishop et al. | |
| 7,014,222 | B1 | 3/2006 | Poppe | |
| 7,159,668 | B2 | 1/2007 | Herrera | |
| 8,069,925 | B2 | 12/2011 | Obrejanu | |
| 2002/0101017 | A1 | 8/2002 | Kolarik | |
| 2003/0150611 | A1 | 8/2003 | Buytaert | |
| 2003/0006609 | A1 | 9/2003 | Yates | |
| 2004/0255444 | A1 | 12/2004 | Gerber | |
| 2005/0242586 | A1 | 11/2005 | Vorley et al. | |
| 2006/0059677 | A1 | 3/2006 | Mckay | |
| 2008/0223573 | A1 | 9/2008 | Nelson et al. | |
| 2008/0261445 | A1 | 10/2008 | Malloy et al. | |
| 2010/0252274 | A1 | 10/2010 | Buytaert et al. | |
| 2010/0326671 | A1 | 12/2010 | Buytaert et al. | |
| 2014/0000900 | A1 * | 1/2014 | Leiper | E21B 37/00 166/311 |

FOREIGN PATENT DOCUMENTS

| | | |
|---|---|---|
| DE | 2214803 | 9/1973 |
| DE | 2433946 | 2/1976 |
| DE | 2949048 | 6/1981 |
| EP | 0164950 | 12/1985 |
| EP | 0221867 | 5/1987 |
| EP | 2105227 | 9/2009 |
| FR | 1220873 | 5/1960 |
| FR | 2173831 | 10/1973 |
| GB | 787220 | 12/1957 |
| GB | 838594 | 6/1960 |
| GB | 1375773 | 11/1974 |
| GB | 2002477 | 2/1979 |
| NL | 7203097 | 9/1973 |
| RU | 49881 | 12/2005 |
| SU | 945356 | 7/1982 |
| WO | 08062177 | 5/2008 |
| WO | 2008062177 | 5/2008 |

OTHER PUBLICATIONS

Centek Group, S2 Centralizer (http://centekgroup.com/our-products/s2-centralizer/), Dec. 31, 2001.

Duct Shop, Start Collars, Jul. 9, 2007.

Eneroil, Stop Collars (http://www.eneroiloffshore.com/stop-collars.html#.Wg5qFVWnGJA), Apr. 13, 2004.

Halliburton, Stop Collars (http://www.halliburton.com/en-US/ps/cementing/casing-equiment/casing-attchements/stop-collars.page), Jul. 28, 2006.

Revata, Centralizers and Stop Collars (http://www.revataengineering.com/rotating-centralizer.htm), Aug. 17, 2008.

* cited by examiner

DEVICE ARRANGED FOR ATTACHING A PIPE STEM ON A TUBULAR BODY

CROSS-REFERENCE TO RELATED APPLICATIONS

The present application is a continuation of U.S. application Ser. No. 14/412,953, filed Jan. 5, 2015, which application published as US 2018/0181892 on Jul. 9, 2015 and granted to U.S. Pat. No. 9,982,494 on May 29, 2018, which application is the U.S. national stage application of International Application PCT/NO2013/000031, filed Jul. 10, 2013, which international application was published on Jan. 16, 2014, as International Publication WO2014/011056 in the English language. The international application is incorporated herein by reference, in entirety. The international application claims priority to Norwegian Patent Application No. 20120803, filed Jul. 12, 2012, Norwegian Patent Application No. 20121235, filed Oct. 22, 2012 and Norwegian Patent Application No. 20130208, filed Feb. 7, 2013, which applications are incorporated herein by reference, in entirety.

FIELD

The present invention relates to an attachment device for an element made to be arranged on a downhole tubular body.

BACKGROUND

In the oil and gas industry, elements that are attached to a downhole tubular body, for example to a production tubing, are used for a number of purposes. An example of such elements is so-called stabilizers or centralizers placed externally on the tubular body. The purpose of a stabilizer may be to ensure that a downhole unit is stabilized centrally in a surrounding tubular body. On casing, for example, stabilizers are used as spacers ensuring sufficient radial spacing between two casings, so that the introduction of cement is done in a satisfactory way. For other downhole units, stabilizers may be used to reduce the radial movement, especially for long, slim units like bottom-hole assemblies (BHA), for example. In one embodiment, the stabilizers are fixedly arranged on the jacket surface of a relatively short mandrel which, when necessary, is slipped over the tubular body, which is to be equipped with stabilizers, and attached there. The stabilizers may exhibit a wide variety of shapes; both straight and helical stabilizer elements are well known in the trade. Stabilizer assemblies of this kind, termed stabilizer pipes in the further description, may be floatingly arranged on the downhole body, that is to say they are fixed only axially on the downhole unit so that the stabilizer pipe may rotate on the downhole unit and thereby be stationary when the downhole unit rotates, the axial fixing being provided by means of stop sleeves that are attached to the downhole unit by shrinking, pressing, screws and so on. In other applications, the stabilizer pipe is fixed in a rotationally rigid manner to the downhole unit in order to follow as the downhole unit rotates. The attachment is carried out in the same manner as that mentioned for the stop sleeves. An attachment of this kind may require large and expensive tools, and some of the attachment methods, for example pressing, often cause lasting deformation of the contact surfaces of the relevant downhole unit.

Stabilizers and centralizers are also found as pipe sections which are mounted in the pipe string in need of stabilization (stabilizer sub) by the pipe section being provided, at its ends, with threaded portions corresponding to the threaded portions of the adjacent pipes. This invention does not relate to this form of stabilizers and centralizers.

Other examples of elements that require attachment to a downhole tubular body are sand filters in a production tubing and conduits arranged externally on the production tubing for conveying control signals, hydraulic fluid and so on.

SUMMARY

The invention has for its object to remedy or reduce at least one of the drawbacks of the prior art or at least provide a useful alternative to the prior art.

The object is achieved through features which are specified in the description below and in the claims that follow.

On an end portion of a sleeve, an attachment portion is arranged. The attachment portion includes a clamping portion extending from the end of the sleeve and is provided with one or more clamping elements arranged to be moved in a radial direction towards an encircled tubular body. The clamping element may be a lip projecting in the axial direction of the sleeve, the clamping portion being lobed. The slits are preferably parallel, typically running in the axial direction. Alternatively, the clamping element may be formed as a loose clamping piece which is arranged in a recess in the clamping portion. The inward displacement of the clamping piece in the recess is preferably restricted, typically by means of projecting portions that may rest against corresponding ledges on the side edges of the recess. Adjacent to the clamping portion and on the jacket surface of the sleeve, an external locking portion is arranged, which is arranged to be surrounded by an adapter sleeve.

In one embodiment, the locking portion is composed of an externally threaded portion arranged to receive the adapter sleeve formed as a nut. The nut is provided with an engagement portion in the form of an internally threaded portion extending substantially from an end of the nut.

In another embodiment, the adapter sleeve engages the attachment portion by means of a catch system, for example by the locking portion being provided with one or more external catches, each extending in the circumferential direction across an area of the attachment portion which is slit by slits penetrating parts of the attachment portion, for example the slits of the lobed clamping portion mentioned above. Internally to the locking portion, the attachment portion exhibits a recess which, with its diameter larger than that of the adjacent portions of the centre bore of the mandrel, extends beyond the axial extent of the locking portion. The slitting of the attachment portion together with the corresponding internal recess allows the locking portion to be pressed inwards when the adapter sleeve, which, in this embodiment, is provided with one or more engagement elements projecting inwards, is moved in over the locking portion. The catch(es) is/are typically provided with a first conical side face facing the end of the clamping portion, for example with a pitch in the range of 20-35°. The opposite second side face forms an abutment surface, for example as a shoulder standing perpendicularly to the centre axis of the clamping portion. Correspondingly, the engagement element/elements on the adapter sleeve may have a cross section complementary to the cross section of the catch, so that an engagement element will slide with its conical inward side face on the conical outward side face of the catch as the locking portion is compressed in the radial direction until the engagement element engages behind said catch by its axially supporting abutment against the abutment surface of the catch. In this embodiment, the engagement elements are typically similarly shaped and regularly spaced axially. The locking portion may typically be provided with several catches spaced apart axially, the axial spacing pitch corresponding to the distance between the engagement elements of the adapter sleeve. Alternatively, the engagement elements may be made up of one or more pawls.

Adjacent to the internal threads, or the area provided with engagement elements, of the adapter sleeve a conical abutment portion is arranged, exhibiting a decreasing diameter in the direction away from the threaded portion.

By moving the adapter sleeve in over the sleeve, the conical abutment portion of the adapter sleeve successively forces the clamping element(s) of the clamping portion inwards in a radial direction into abutment against the tubular body on which the sleeve is placed. The adapter sleeve is brought to be axially fixed on the sleeve through engagement between the threads by rotation of the adapter sleeve, or between the catch(es) and the engagement element/elements by axial displacement of the adapter sleeve. Provided that the jacket surface of the tubular body has a circular cross section, the clamping elements will, when several clamping elements are distributed over the entire circumference of the sleeve, rest evenly against the tubular body. The sleeve which is formed in accordance with the invention could be clamped to any portion of the jacket surface of the tubular body without deforming the jacket surface.

The lip-shaped clamping element preferably has a decreasing thickness in the direction away from the externally threaded portion, that is to say towards its free end, as an inward contact surface is gently conical in order to form, in an active position, a best possible abutment against the tubular body. Correspondingly, the separate clamping piece is provided with conical abutment surfaces corresponding to the conical abutment portion of the adapter sleeve.

To prevent the adapter sleeve in the form of a nut from unscrewing during the rotation of the tubular body, it is an advantage for the thread direction to be the opposite of the normal rotational direction of the tubular body.

To further secure the adapter sleeve in the form of a nut, the nut may include a securing system, the nut being provided with a locking portion which includes one or more elevations projecting inwards, which are arranged to engage a latch groove arranged within the externally threaded portion of the sleeve. It is an advantage if the sleeve is provided with several latch grooves arranged in parallel in the axial direction of the sleeve. The nut may thereby lockingly engage the sleeve in several axial positions. The locking portion of the adapter sleeve may be continuous or interrupted, that is to say sectioned.

The securing system may alternatively have a design corresponding to that of the catch system described above.

The sleeve may form a mandrel, on a jacket surface of which, one or more function elements are fixed, for example stabilizing or centralizing elements, typically in the form of ribs projecting from and evenly distributed on the circumference of the mandrel. A sleeve in the form of an elongated mandrel may be provided with an attachment portion integrated in both end portions of the mandrel. The sleeve can also be used separately from a mandrel of this kind, but is used as an end abutment limiting the axial movement of the mandrel and allowing the mandrel to rotate freely on the tubular body which is to be provided with said function elements.

The invention does not exclude the use of the same technical solution for positioning other elements which are to be placed temporarily or permanently in such a way that they project from the circumference of a downhole tubular body. The sleeve may be provided with attachment elements for function elements extending along a tubular body, for example conduits for carrying electric signals or fluid, typically a hydraulic conduit. In its simplest form, the attachment element may be a projecting pin or a recess in the sleeve.

In a first aspect, the invention relates more specifically to an attachment device for an element made to be arranged on a downhole tubular body, characterized by an end portion of a sleeve, which is arranged to surround a portion of the tubular body, being provided with an attachment portion which includes at least one clamping element which is arranged to be displaced axially by the abutment of an abutment surface against a conical abutment portion of a surrounding nut.

The clamping element may be formed as a lip projecting in the axial direction from an external locking portion of the end portion.

The lip may have a gradually decreasing thickness in the direction from the external locking portion, as an inward contact surface is conical.

The clamping element may alternatively be formed as a curved clamping piece arranged in a recess in the end portion.

One or more of the side edges of the recess may form a ledge arranged to receive a corresponding collar portion arranged on the clamping element.

The locking portion may be formed as a threaded portion arranged to engage an internally threaded portion of the adapter sleeve.

The locking portion may be formed as at least one catch extending in the circumferential direction of a jacket surface of the attachment portion and being arranged to engage a corresponding engagement element projecting inwards on the adapter sleeve, the circumferential extent of the catch being defined by slits penetrating the locking portion at least and extending substantially in the axial direction of the attachment portion.

The attachment portion may be provided with an internal recess which is encircled by the locking portion and has an axial extent larger than the axial extent of the locking portion.

A jacket surface adjacent to the externally threaded portion may be provided with at least one latch groove arranged to receive a complementary engagement portion arranged inwards-projectingly on the adapter sleeve with a distance to the abutment portion. The engagement portion may be continuous or discontinuous.

The pitch direction of the threaded portions may be the opposite of the normal rotational direction of the tubular body.

The tubular body may be a casing, a liner or a bottom-hole assembly.

The locking portion may be formed as a threaded portion arranged to engage an internally threaded portion of the adapter sleeve, and the locking portion may include at least one catch extending in the circumferential direction of a jacket surface of the attachment portion and being arranged to engage a corresponding engagement portion projecting inwards on the adapter sleeve, the circumferential extent of the catch being defined by slits penetrating at least parts of the locking portion and extending substantially in the axial direction of the attachment portion.

The sleeve may be provided with one or more function elements taken from a group consisting of stabilizing elements, centralizing elements, sand screens and cable clamps.

The sleeve may be provided with one or more anchoring points for a function element.

The sleeve may be formed as a mandrel provided with one or more function elements projecting axially.

In a second aspect, the invention relates more specifically to a pipe string including several tubular bodies, characterized by one or more tubular bodies being provided with at least one mandrel fixed to said tubular bodies by an attachment device as described above being releasably engaged in a portion of said tubular bodies.

BRIEF DESCRIPTION OF THE DRAWINGS

In what follows, an example of a preferred embodiment is described, which is visualized in the accompanying drawings, in which.

DETAILED DESCRIPTION OF THE DRAWINGS

Figure 1:
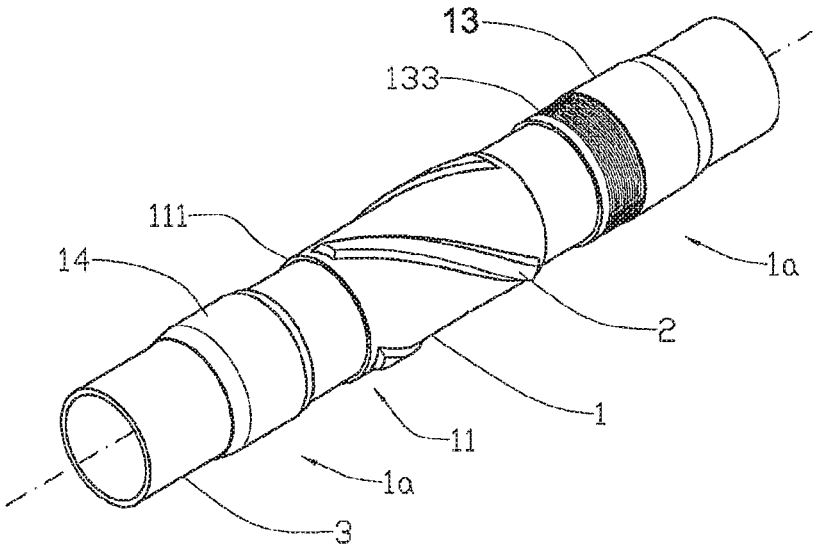
FIG. 1 shows a mandrel axially fixed with two sleeves according to the invention, the sleeves having been pulled slightly away from the end faces of the mandrel for the sake of exposure, and the mandrel being provided with stabilizers attached to an external jacket surface.
Figure 2:
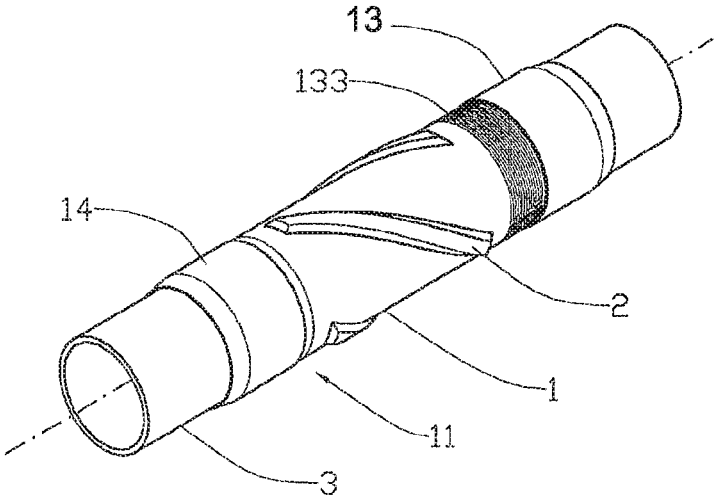
FIG. 2 shows, in perspective, two sleeves according to the invention integrated in the mandrel.

In the figures, the reference numeral 1 indicates a sleeve in the form of an elongated mandrel provided with several function elements 2, shown in FIGS. 1 and 2 as ribshaped stabilizing elements projecting from a jacket surface 12 of the mandrel 1. The mandrel 1 is arranged to releasably surround a portion of a tubular body 3, shown schematically in FIGS. 1 and 2 as a casing. In FIG. 1, the mandrel 1 is fixed by means of two separate sleeves 1*a*, for example when it is desirable that the mandrel 1 with the function elements 2 should be rotatable on the tubular body 3, as an attachment sleeve 1*a* is positioned in an axially supporting manner against both end portions 11 of the mandrel 1, which, in this embodiment, have straight end faces 111. The sleeves 1*a* are attached in a rotationally rigid manner to the tubular body 3 so that the mandrel 1 may rotate freely. In FIG. 2, attachment devices for the sleeves 1*a* are integrated in both end portions 11 of the mandrel 1 so that the mandrel 1 is attached to the tubular body 3 in a rotationally rigid manner.

In the following description, the attachment device is described in relation to the sleeve 1*a*, but is valid also when the sleeve 1*a* forms an elongated mandrel 1 provided with said attachment device(s).

An end portion 11 of the sleeve 1*a* is provided with an attachment portion 13 which, in a first embodiment (see FIG. 3) includes a clamping portion 131 arranged to abut in a holding manner against the tubular body 3. The clamping portion 131 is formed from several lip-shaped clamping elements 1312 projecting in the axial direction from the sleeve 1*a*, the clamping elements 1312 being separated by slits 1311. The slits 1311 are shown here as straight-lined and parallel and are arranged in the axial direction of the sleeve 1*a*, but other designs are possible as well. The internal side faces of the to clamping elements 1312 form clamping faces 1313 arranged to rest, in an active position, against the tubular body 3. The clamping faces 1313 are gently conical with an increasing diameter towards the free ends of the clamping elements 13, typically with a pitch angle in the range of 2-5°. The pitch angle roughly corresponds to the pitch angle of the abutment surface 142 of an encircling adapter sleeve 14 (see below) to provide the desired contact between the clamping faces 1313 and the surrounded tubular body 3. In one embodiment (see FIGS. 6 and 7), a portion of the clamping faces 1313 constitutes a gripping face 1313', shown as toothed here, but other friction-enhancing designs may be used, for example serration.

In a second embodiment (see FIGS. 4*a* and 4*b*), the attachment portion 13 is provided with several recesses 132, each accommodating a clamping element 1312' in the form of a curved clamping piece provided with a conical, outward, abutment surface 1315 and a cylindrical, inward, clamping face 1313. The clamping face 1313 is preferably rough, for example serrated, to exhibit sufficiently large friction against a surface. The recess 132 is provided with ledges 1321 arranged to receive corresponding collar portions 1314 having the effect of preventing the clamping element 1312' from falling out of the recess 132.

In one embodiment, a locking portion 133 is arranged to engage in the adapter sleeve 14 in an axially fixing manner as the locking portion 133 is formed as an externally threaded portion extending along a portion of the jacket surface 12 from the bottom of the slits 1311.

In this embodiment, the adapter sleeve 14 is formed as a nut provided with an internally threaded portion 141 complementary to the externally threaded portion 133 of the sleeve 1*a*. In the further description, the term "nut" is partly used when the adapter sleeve 14 is provided with an internally threaded portion 141.

Figure 6A:
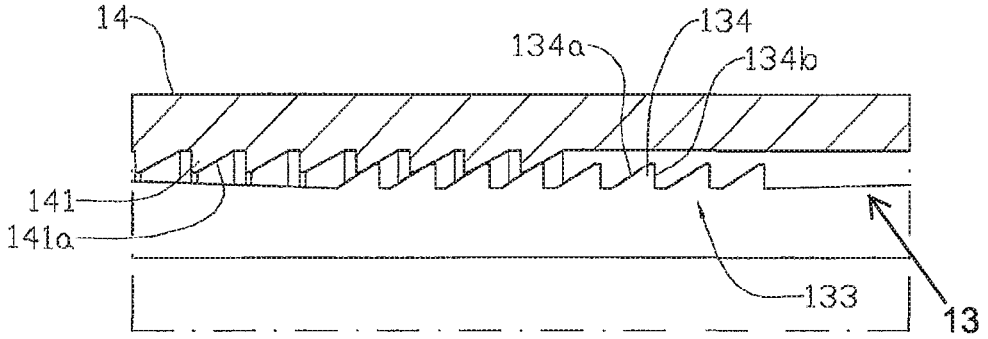
FIG. 6*a* shows an enlarged section of the catch system.
Figure 6:
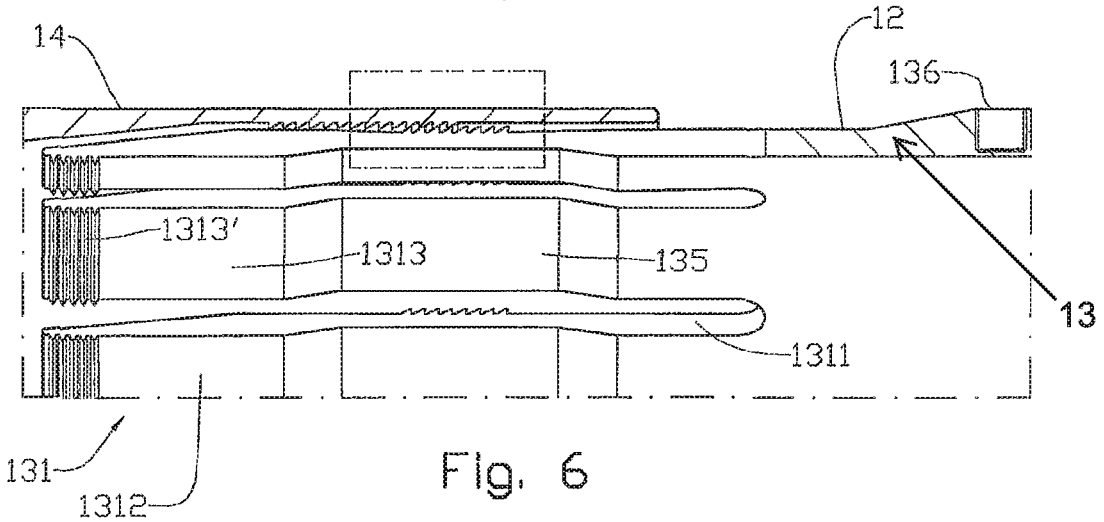
FIG. 6 shows an axial section through an attachment portion and an adapter sleeve provided with a catch system, in which engagement elements projecting inwards on the adapter sleeve are being moved into engagement with corresponding catches on the attachment portions.
Figure 7:
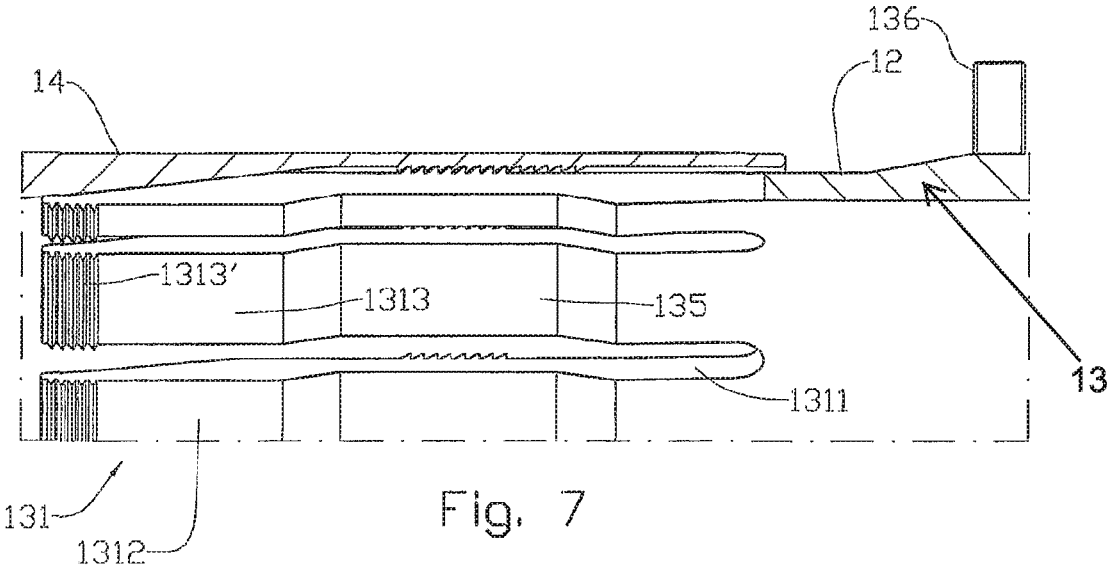
FIG. 7 shows a view corresponding to FIG. 6, but where the engagement elements are fully engaged in the catches.

In another embodiment, the axial fixing of the adapter sleeve 14 on the attachment portion 13 is provided by a catch system, the locking portion 133 including several external catches 134, each extending in the circumferential direction of the jacket surface 12 across a region of the attachment portion 13 which is split by slits, shown in FIGS. 6 and 7 as the slits 1311 defining the clamping elements 1312. Internally to the locking portion 133, the attachment portion 13 exhibits a recess 135 which, with its diameter larger than that of the adjacent portions of the centre bore of the sleeve 1*a*, extends beyond the axial extent of the locking portion 133. The slitting of the attachment portion 13 together with the corresponding internal recess 135 allows the locking portion 133 to be pressed inwards when the adapter sleeve 14 (see FIG. 7), which, in this embodiment, is provided with engagement elements 141 projecting inwards, is moved in over the locking portion 133. In the embodiment shown, the catches 134 are provided with a first, conical side face 134*a* facing the end of the clamping portion 131, for example with a pitch in the range of 20-35°, about 30° shown here. An opposite, second side face 134*b* forms an abutment surface, shown here as a shoulder standing perpendicularly to the centre axis of the clamping portion 131. Correspondingly, the engagement elements 141 of the adapter sleeve 14 have a cross section complementary to the cross section of the catches 134 so that an engagement element 141 will slide with a conical, inward side face 141*a* on the conical outward side face 134*a* of the catch 134 as the locking portion 133 is compressed in the radial direction until the engagement element 141 engages behind said catch 134 by its axially supporting abutment against the abutment surface 134*b* of the catch 134. In this embodiment, the engagement elements 141 are typically similarly shaped and arranged with regular axial spacing. Here, the locking portion is shown with several catches 134 spaced apart axially, the axial spacing pitch corresponding to the spacing of the engagement elements 141 of the adapter sleeve 14.

Figure 3:
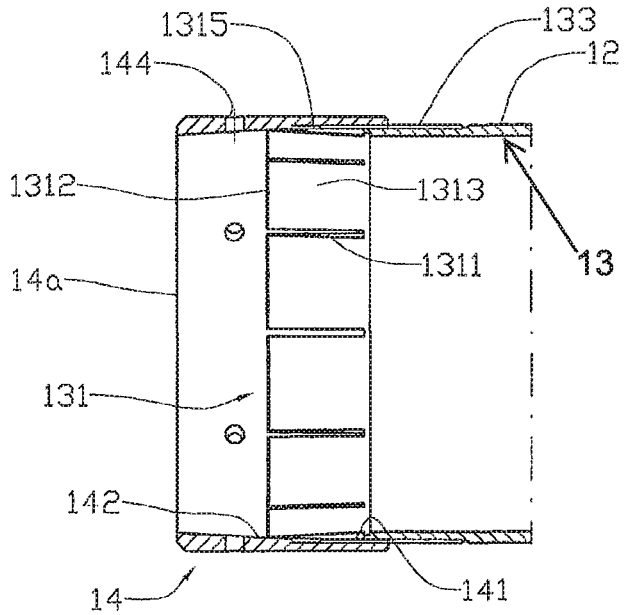
FIG. 3 shows, on a larger scale, an axial section through an attachment portion with an adapter sleeve formed as a nut screwed partially onto the attachment portion.
Figure 4A:
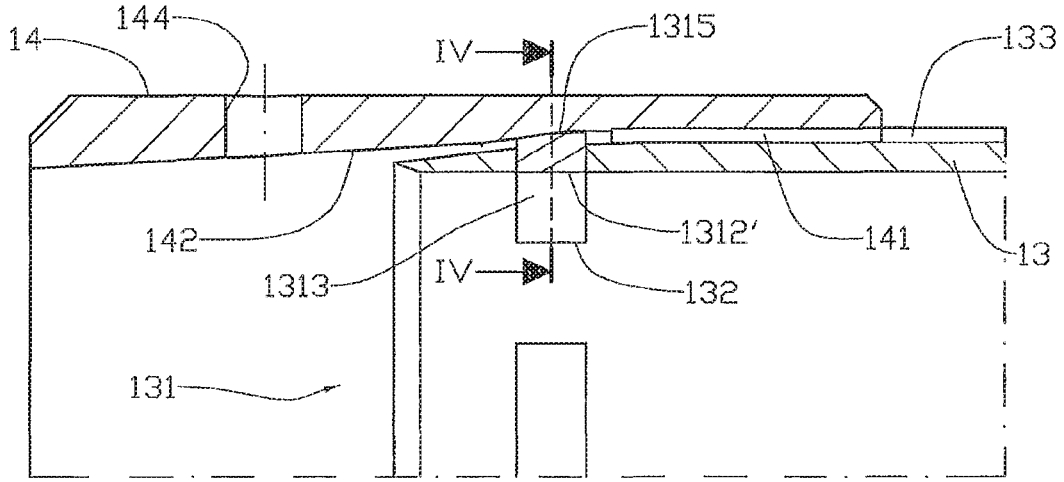
FIG. 4*a* shows, on a larger scale, an axial section through an alternative embodiment of the attachment portion.
Figure 4B:
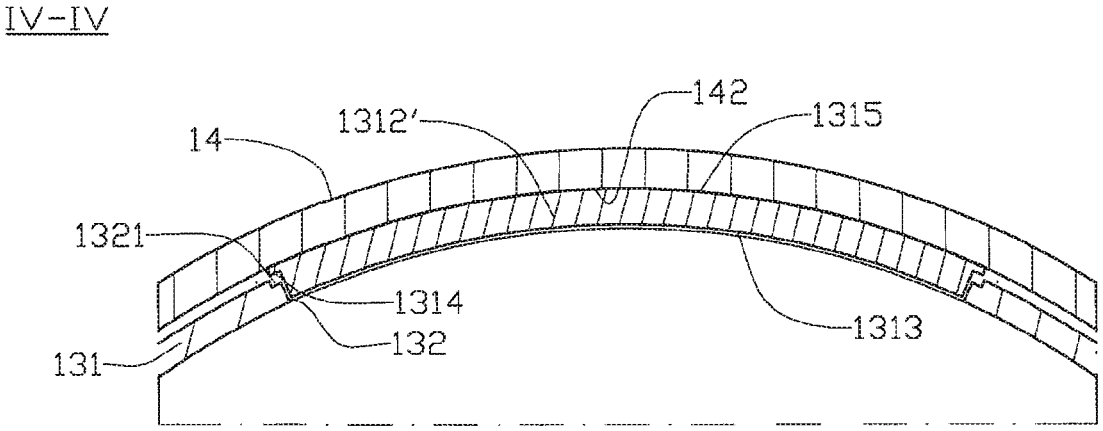
FIG. 4*b* shows a radial section IV-IV according to FIG. 4*a;*

Reference is now made to FIGS. 3 and 4*a* in particular. Between the engagement elements 141 and a first end 14*a* of the adapter sleeve 14, a conical abutment portion 142 extends with a diameter decreasing in the direction away from the engagement elements 141. The pitch angle of the conical abutment portion 142 is preferably equal to the pitch angle of the clamping faces 1313 of the clamping element 1312 or the abutment surface 1315 of the clamping elements 1312', in order thereby to provide good contact between the clamping faces 1313 of the lips 1312 or clamping pieces 1312' and the surrounded tubular body 3 when the clamping elements 1312, 1312' are in their active positions.

In the embodiment as a nut, the adapter sleeve 14 is provided with several grip portions 144 (se FIGS. 3 and 4*a*), shown here as cut-outs extending through the conical portion of wall of the adapter sleeve 14. The grip portions 144 are arranged to be releasably engaged by a tool (not shown) for rotating the nut 14.

Figure 5:
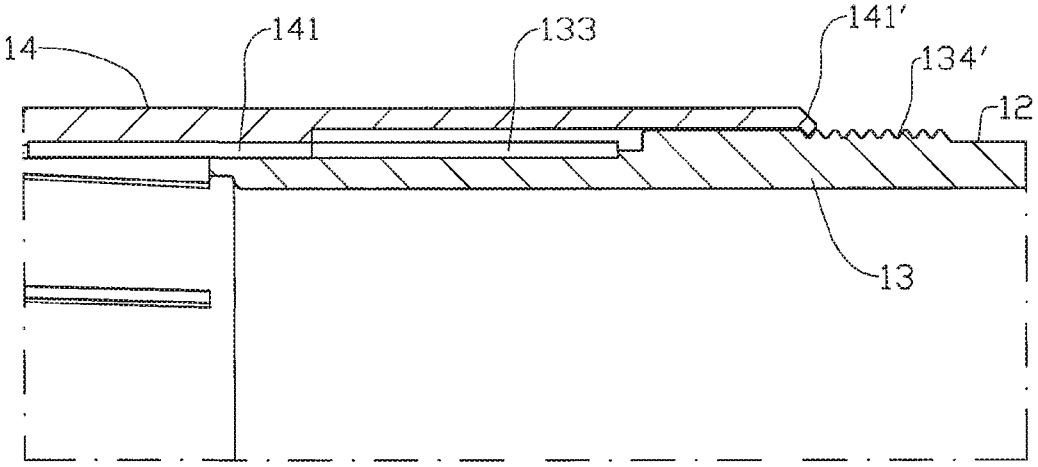
FIG. 5 shows, on a larger scale, an axial section of a section of an alternative embodiment of the attachment portion and the nut, a locking portion in an end portion of the nut being engaged in a latch groove in the mandrel.

Reference is now made to FIG. 5, in which an embodiment with several parallel latch grooves 134' arranged adjacent to the externally threaded portion 133 is shown. A complementary engagement element 141' projects inwards like a ridge from the internal wall surface of the nut 14, with a distance to the internally threaded portion 141. The engagement element 141' is arranged to be yielding so that by the axial displacement of the nut 14 on the externally threaded portion 133, it may climb on the side edges of the latch grooves 134. The engagement portion 141' may, for example, be formed as a yielding one by the use of a small material thickness in the adjacent portion of the wall of the nut 14, possibly by the engagement portion 141' and the adjacent portion of the wall of the nut 14 being split with slits arranged axially (not shown).

Alternatively, the nut 14 may be provided with a catch system, as described above and shown in the FIGS. 6 and 7, to prevent the nut 14 from unscrewing.

It is obvious to provide both end portions 11 of a sleeve 1*a* formed as a mandrel 1*a* with attachment portions 13 of the kind as described above. It is also obvious to choose a thread direction that will prevent the nut 14 from unscrewing as the tubular body 3 is rotated in its normal direction of rotation.

When a pipe string that is being constructed from said tubular bodies 3 is to be provided with function elements 2, for example a new casing is to be centred in a previously installed casing in such a way that sufficient clearance is ensured between the casings for the satisfactory introduction of cement, a mandrel 1 with function elements 2 and adapter sleeve/sleeves 14 is slipped over the relevant tubular body 3 and fixed in the desired position by the adapter sleeve/sleeves 14 being clamped in such a way that the clamping faces 1313 and possible gripping faces 1313' of the clamping elements 1312 are pressed against the jacket surface of the tubular body 3. By the use of attachment sleeves 1*a* according to the invention, the mandrel 1, attachment sleeve/sleeves 1*a* and adapter sleeve/sleeves 14 are slipped over the tubular body 3 in the desired order and orientation. The attachment sleeve/sleeves 1*a* is/are attached in a manner corresponding to that described above. Correspondingly, the sleeve 1*a* is used as an attachment for one or more function elements 2 by the function element 2 being attached to a suitable anchoring point 136 on the sleeve, shown in FIG. 6 as a threaded recess, and shown in FIG. 7 as a projecting threaded pin.

The invention claimed is:

1. A device for attachment to a tubular body comprising:

a first sleeve including an end portion, the sleeve configured to surround the tubular body, the end portion comprising a plurality of axial extensions separated by a plurality of slits, the extensions including a locking portion and a gripping portion; and a second sleeve configured to encircle the end portion of the first sleeve, the second sleeve including a conical abutment portion and a corresponding locking portion configured to engage with the locking portion of the first sleeve;

wherein the gripping portion of the extensions comprises a radially inward facing clamping surface including radially inwardly gripping projections, as well as a radially outward facing abutment surface opposite the clamping surface the extensions further comprise a radially outward facing abutment surface, the locking portion of the first sleeve comprises a plurality of circumferential annular catches located on the external surface of the first sleeve; and the locking portion of the second sleeve comprises a plurality of complimentary circumferential annular catches located on the internal surface of the second sleeve; and wherein the end portion of the first sleeve and the second sleeve are configured such that when the end portion of the first sleeve is axially brought together with the second sleeve so that the locking portion of the extensions of the first sleeve are engaged with the locking portion of the second sleeve, the conical abutment portion of the second sleeve displaces the abutment surface of the gripping surface.

2. The device of claim 1, wherein the radially inward gripping projections comprise circumferential teeth.

3. The device of claim 2, wherein the radially inward gripping projections comprise a plurality of axially spaced circumferential teeth.

4. The device of claim 2, wherein the locking portion of the axial extensions of the first sleeve further comprises a recess located on the radially inward facing surface, opposite the plurality of catches.

5. The device of claim 4, wherein as the end portion of the first sleeve is axially brought together with the second sleeve so that the locking portion of the extensions of the first sleeve are engaged with the locking portion of the second sleeve, the recess allows the locking portion of the extensions to deflect axially inward.

6. The device of claim 1, wherein the circumferential annular catches located on the first sleeve comprise a sloped first side face facing the distal end of the axial extensions, and an opposite second side face forming an abutment surface approximately perpendicular to a center axis of the first sleeve.

7. The device of claim 6, wherein the sloped first side face has a pitch of about 20 to about 35 degrees.

8. The device of claim 7, where the sloped first side face has a pitch of about 30 degrees.

9. The device of claim 1, wherein the slits are straight and parallel with one another.

10. The device of claim 1, wherein the radially outward facing abutment surface of the extensions is located on the distal end of the extensions.

11. The device of claim 10, wherein the radially outward facing abutment surface is conical.

12. The device of claim 1, wherein the locking portion of the first sleeve is engaged with the locking portion of the second sleeve by a ratchet engagement.

13. An attachment assembly for a tubular body comprising:

a sleeve having a tubular attachment portion, the attachment portion comprising a plurality of clamping elements extending in an axial direction towards a distal end of the attachment portion and arranged for radial displacement toward an encircled tubular body, the clamping elements formed by parallel, axial slits, the plurality of clamping elements comprising a gripping face on an inner surface of the clamping elements, the gripping face comprising teeth, the plurality of clamping elements further comprising at least one circumferential annular catch on an outer surface of the clamping element, the circumferential annular catch comprising a sloped first side face facing the distal end of the clamping element and an opposite second side face forming an abutment surface approximately perpendicular to a center axis of the sleeve; and an adapter sleeve arranged to inwardly, radially displace the clamping elements, the adapter sleeve comprising an engagement element projecting inwards having a complementary cross section to a cross section of the circumferential annular catch, wherein the attachment assembly is arranged such that when the adapter sleeve is moved in over the attachment portion, the adapter sleeve displaces the clamping elements inwards and the engagement element slides over the sloped first side face until the engagement element engages behind the catch by axially supporting abutment against the abutment surface of the catch.

14. The assembly of claim 13, wherein the teeth extend circumferentially around an inner surface of the clamping elements.

15. The assembly of claim 14, wherein the sloped first side face has a pitch of about 20 to about 35 degrees.

16. The assembly of claim 14, wherein the tubular attachment portion further comprises a plurality of circumferential annular catches spaced apart axially.

17. The assembly of claim 16, where wherein the adapter sleeve comprises a plurality of engagement elements spaced apart axially and wherein an axial spacing of the circumferential annular catches corresponds to axial spacing of the engagement elements.

18. The assembly of claim 13, wherein the slits are straight and parallel with one another.

19. The assembly of claim 13, wherein the adapter sleeve comprises a conical abutment portion having a decreasing diameter away from the engagement elements.

20. The assembly of claim 13, further including a centralizer attached to the sleeve having a tubular attachment portion, the centralizer axially attached to the end of the sleeve opposite the attachment portion of the sleeve.

21. The device of claim 13, wherein the engagement element engages the catch by a ratchet engagement.

22. An assembly for tubular body comprising:

a centralizer deployed on the tubular body; and an attachment device deployed and fixed on the tubular body, the attachment device adjacent to the centralizer, the attachment device comprising;

a sleeve having a tubular attachment portion, the attachment portion comprising a plurality of clamping elements extending in an axial direction towards a distal end of the attachment portion and encircling tubular body, the clamping elements formed by slits penetrating the attachment portion, the plurality of clamping elements comprising a gripping face on an inner surface of the clamping elements, the gripping face comprising a plurality of axially spaced circumferential teeth at least partially embedded into the surface of the tubular body, the plurality of clamping elements further comprising at least one circumferential annular catch on an outer surface of the clamping element, the circumferential annular catch comprising a sloped first side face facing the distal end of the clamping element and an opposite second side face forming an abutment surface approximately perpendicular to a center axis of the sleeve; and an adapter sleeve that encircles and engages with the tubular attachment portion, providing inward radial force upon the clamping elements, the adapter sleeve comprising an engagement element projecting inwards having a complementary cross section to a cross section of the circumferential annular catch.

23. The assembly of claim 22, wherein the centralizer comprises an elongated mandrel configured to surround a portion of the tubular body, the mandrel including a plurality of stabilizing ribs projecting from the outer surface of the mandrel.

24. The assembly of claim 22, wherein the attachment device is integrally attached to centralizer.

25. The assembly of claim 22, wherein the attachment device prevents the centralizer from moving in the axial direction along the tubular body.

26. The assembly of claim 22, wherein the tubular body is a casing, a liner or a bottom-hole assembly.

27. The assembly of claim 22, wherein the slits of the attachment portion further separate the circumferential annular catches of the respective clamping elements, defining the circumferential extent of the circumferential annular catches.

28. The device of claim 22, wherein the engagement element engages the circumferential annular catch by a ratchet engagement.

* * * * *